US007050602B2

(12) United States Patent
Miller

(10) Patent No.: US 7,050,602 B2
(45) Date of Patent: May 23, 2006

(54) LOW CAPACITANCE RECEIVER COIL

(75) Inventor: Thomas E. Miller, Arlington Heights, IL (US)

(73) Assignee: Knowles Electronics LLC., Itasca, IL (US)

( * ) Notice: Subject to any disclaimer, the term of this patent is extended or adjusted under 35 U.S.C. 154(b) by 469 days.

(21) Appl. No.: 09/928,673

(22) Filed: Aug. 13, 2001

(65) Prior Publication Data

US 2002/0021817 A1 Feb. 21, 2002

Related U.S. Application Data

(60) Provisional application No. 60/225,124, filed on Aug. 14, 2000.

(51) Int. Cl.
*H04R 1/00* (2006.01)

(52) U.S. Cl. ..... 381/418; 381/324

(58) Field of Classification Search ..... 381/401, 381/402, 417, 418, 312, 313, 314, 315, 316, 381/317, 318, 319, 320, 321, 322, 323–331, 381/409, 410, 400, 182, 186, 408; 29/603.24, 29/896.21, 605, 594; 336/190, 219; 335/299; 379/390.03, 394, 395

See application file for complete search history.

(56) References Cited

U.S. PATENT DOCUMENTS

| | | | | |
|---|---|---|---|---|
| 3,873,784 | A * | 3/1975 | Doschek | 381/186 |
| 3,982,814 | A * | 9/1976 | Kaiserswerth et al. | 323/355 |
| 5,124,681 | A * | 6/1992 | Chen | 29/605 |
| 5,594,386 | A | 1/1997 | Dhuyvetter | |
| 5,594,805 | A * | 1/1997 | Sakamoto et al. | 381/412 |
| 5,757,947 | A | 5/1998 | Van Halteren et al. | |
| 5,812,598 | A * | 9/1998 | Sharma et al. | 375/259 |
| 5,828,767 | A * | 10/1998 | Button | 381/401 |
| 5,858,154 | A * | 1/1999 | Toki | 29/602.1 |
| 6,075,870 | A * | 6/2000 | Geschiere et al. | 381/417 |
| 6,658,134 | B1 * | 12/2003 | van Hal et al. | 381/418 |
| 6,738,490 | B1 * | 5/2004 | Brandt | 381/421 |

FOREIGN PATENT DOCUMENTS

| | | | |
|---|---|---|---|
| EP | 0 533 284 | | 3/1993 |
| JP | 55105498 | A * | 8/1980 |
| JP | 55121795 | A * | 9/1980 |
| JP | 10-032897 | * | 3/1998 |
| JP | 10106855 | * | 4/1998 |
| JP | 2000058357 | A * | 2/2000 |

OTHER PUBLICATIONS

Henney, Keith, "The Radio Engineering Handbook",1941, pp. 84 & 85, Third Edition, McGraw-Hill Book Company, Inc., New York and London.

(Continued)

*Primary Examiner*—Sinh Tran
*Assistant Examiner*—Brian Ensey
(74) *Attorney, Agent, or Firm*—Marshall, Gerstein & Borun LLP

(57) ABSTRACT

The disclosure relates to electroacoustic receivers of the type which incorporate a reed armature. Thus, a receiver comprises a coil, magnets, pole pieces and a reed armature which passes through a central tunnel defined by the coil. A central portion of the reed lies within the tunnel. The coil includes a predetermined winding for decreasing the parasitic capacitance of the coil.

38 Claims, 2 Drawing Sheets

OTHER PUBLICATIONS

Electronic Engineers of the Westinghouse Electric Corporation, "Industrial Electronics Reference Book", 1948, John Wiley & Sons, Inc., New York and Chapman & Hall, Limited, London.

Langford-Smith, F., "Radiotron Designer's Handbook", 1953, pp. 450-481, Fourth Edition, Wireless Press for Amalgamated Wireless Valve Company Pty. Ltd., 47 York Street, Sydney, Australia.

Terman, Frederick Emmons, "Radio Engineering", 1947, pp. 30-39, Third Edition, McGraw-Hill Book Company, Inc., New York and London.

International Preliminary Exemination Report dated Nov. 11, 2002 re PCT/US01/41755.

* cited by examiner

LOW CAPACITANCE RECEIVER COIL

RELATED APPLICATION

This Application claims the benefit of Provisional Patent Application Ser. No. 60/225,124, filed Aug. 14, 2000.

TECHNICAL FIELD

The present invention relates generally to hearing aids, and, more particularly, to low capacitance coil winding techniques in hearing aids.

BACKGROUND OF THE INVENTION

An electroacoustic receiver, as used in a hearing aid, typically converts an electric signal to an acoustic sound through a motor assembly having a movable armature. Typically, the armature has one end that is free to move while the other end is fixed to a housing of the receiver. The assembly also includes a drive coil and one or more magnets, both capable of magnetically interacting with the armature. The armature is typically connected to a diaphragm near its movable end. When the drive coil is excited by an electrical signal, it magnetizes the armature. Interaction of the magnetized armature and the magnetic fields of the magnets causes the movable end of the armature to vibrate. Movement of the diaphragm connected to the armature produces sound for output to the human ear.

Digital signal processors (DSP) are also utilized in the manufacture of hearing aids. Hearing aids of this type generally include a DSP, a microphone, a receiver, and an analog-to-digital converter.

The popularity of hearing aids with digital signal processors has created a need for low capacitance receivers. DSP-based hearing aids typically drive the receiver with a pulse width modulated signal having a carrier frequency of 1 to 2 MHz. At these carrier frequencies, parasitic capacitance of the receiver coil adds greatly to the hearing aid's current flow. Thus, precious battery power is wasted. Also, hearing aids provided with switched signal output (such as class D amplification) consume less current when the parasitic capacitance of the receiver is reduced.

There are several well established methods of reducing the capacitance of high frequency inductors. While these methods have been around since the 1940's, they have not been applied in hearing aid components. Low capacitance methods have been avoided in the past for hearing aid receivers, as these methods add to the total coil size and manufacturing effort.

The present invention provides methods of reducing hearing aid receiver coil parasitic capacitance.

SUMMARY OF THE INVENTION

The present invention is directed to a method for producing a hearing aid having a low capacitance receiver coil. One method includes providing a coil with alternate winding schemes, such as coils with a high winding pitch, pie winding, or bank winding. Another method includes providing schemes for insulating the coil's wire, such as providing a coil thicker insulation, insulated interwinding, or adding an insulated layer between coil winding layers.

Other features and advantages of the invention will be apparent from the following specification taken in conjunction with the following drawings.

DETAILED DESCRIPTION OF THE PREFERRED EMBODIMENT

Figure 1:
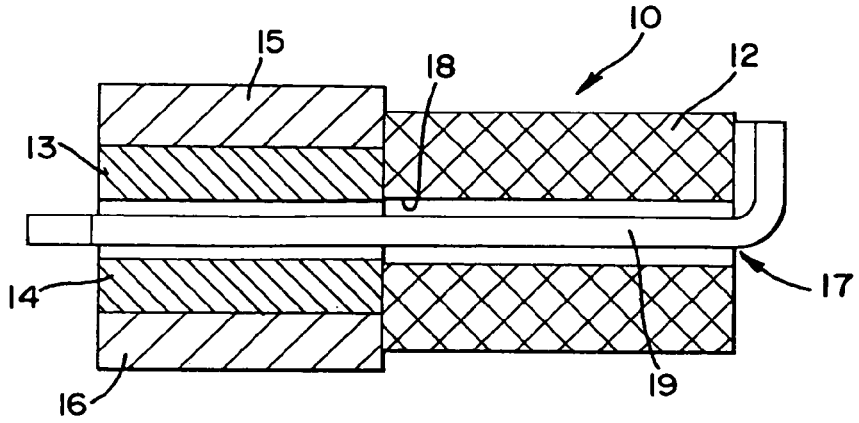
FIG. 1 is a cross sectional stylized view through an electroacoustic receiver with the reed in its central position.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a electroacoustic receiver 10 is illustrated. The receiver 10 comprises a coil 12, magnets 13 and 14, pole pieces 15 and 16 and reed armature 17. As shown in FIG. 1, the coil 12 defines a central tunnel 18 and the magnets 13 and 14 are spaced apart. The reed armature 17 extends along the tunnel 18 and between the magnets 13 and 14. A central portion 19 of the reed 17 lies within the tunnel 18.

The present invention is directed to hearing aids generally including an electroacoustic receiver, a power source (such as a battery), an audio input such as a microphone, a digital signal processor, and an analog-to-digital converter wherein the receiver is driven with a switching signal, for one example a pulse width modulated signal having a carrier frequency of above 50 KHz, preferably within the range of 50 KHz to 2 MHz, more preferably within the range of 1 to 2 MHz, or any range or combination of ranges therein. More particularly, the present invention is directed to methods of winding the receiver coil 12 to limit parasitic capacitance and, thus, increase hearing aid battery life. Accordingly, FIGS. 2 through 7 illustrate methods of providing predetermined winding patterns and/or predetermined winding pitches for the receiver coil 12 which will decrease the capacitance between coil windings.

Figure 2:
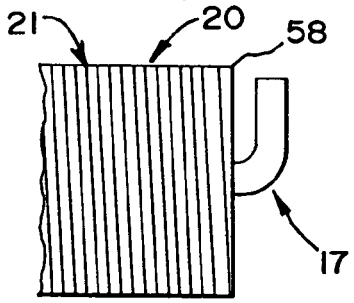
FIG. 2 is a partial side view of an electroacoustic receiver having an increased winding pitch.

Referring to FIG. 2, a coil 12 having a high winding pitch 20 is illustrated. Normally, the spacing between the individual turns of wire is minimized to reduce the total size of the coil 12. Increasing the spacing reduces the capacitive coupling between the turns. The receiver coil 12 is typically wound with tightly spaced turns; however, FIG. 2 illustrates a winding pitch wherein a space 21 between individual turns is three times the thickness of the wire. The space 21 between the individual turns can be greater than three times the thickness of the wire, even as much as six or more times the thickness. This creates a substantial reduction in capacitance. The winding pitch 20 illustrated in FIG. 2 adds significant size to the coil 12 diameter.

Figure 3:
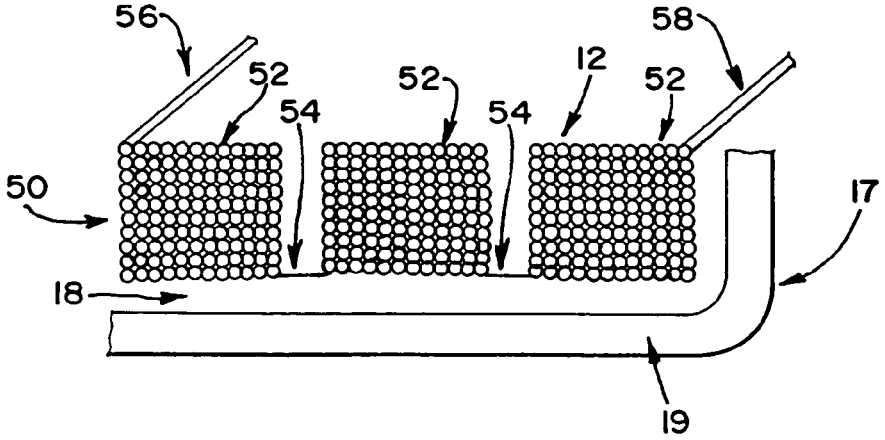
FIG. 3 is a partial cross sectional stylized view through an electroacoustic receiver having a pie wound coil.

Referring to FIG. 3, an upper half of a coil 12 having a pie winding 50 is illustrated. In this embodiment, the coil 12 includes winding modules such as separate pie wound disks 52 (commonly referred to as "pies" by coil winders). The pie wound disks 52 are joined by connection lines 54. Terminal wires 56, 58 extend from the outermost winding disks 52 for electrical connection to hearing aid electronics. This method greatly reduces the capacitance without adding as much to the size of the coil 12. Winding portions of the coil 12 in separate pie wound disks 52 which share a common axis greatly reduces the capacitance without adding as much to the volume of the coil 12 as other methods. The individual pie wound disks 52 are generally spaced a distance which is approximately 5% or less of the length of an individual pie wound disk 52.

In this example, the pie wound disks 52 are produced individually using standard production methods. The pie winding 50 can be produced by providing a bobbin to separate the individual pie wound disks 52. Preferably, the pie wound disks 52 are produced individually and subsequently assembled into the pie winding 50. The pie wound disks 52 are stacked and electrically connected when the receiver is assembled. This improvement eliminates the need for a bobbin in the receiver. The spacing between the pie wound disks 52 is important in controlling the capacitance and is controlled by bumps on the end of the coil body. The bumps can be molded into the coil 12 by using indents in the coil winding form.

Figure 4:
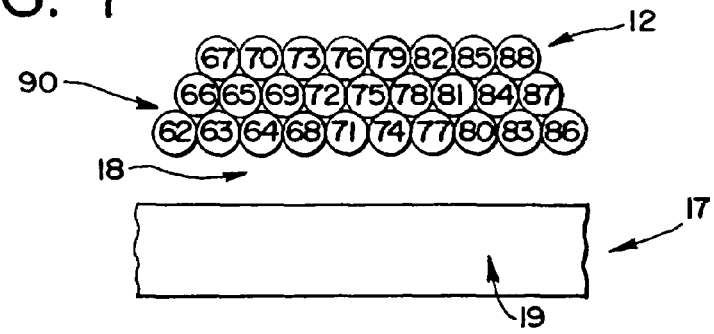
FIG. 4 is a partial cross sectional stylized view through an electroacoustic receiver having a bank wound coil.

Referring to FIG. 4, an upper portion of a coil 12 having a bank or progressive winding is illustrated. FIG. 4 shows a bank winding comprising a special sequence of wire turns to form a boundary layer or end portion 90 which is wound to the final diameter of the coil. Once the final diameter is reached, turns are wound against the end portion in radially extending layers down the length of the tunnel 13.

In the example illustrated, there are twenty-seven turns 62–88. The first six turns 62–67 are wound to form the end portion 90 until a predetermined final diameter is reached. Once the final diameter of the coil 12 is reached the remaining turns 68–82 are wound in layers progressively down the coil 12.

In this example, the end portion 90 is formed by a first plurality of individual wire turns originating at a point adjacent the tunnel. A first layer, designated by turns 62–64, is wound in a first direction along a first portion of the length of the tunnel. A second layer, designated by 65 and 66, is wound about the first layer in a second direction along a second portion of the length of the tunnel. The second direction is opposite to the first direction, and the second portion of the length of the tunnel is shorter than the first portion of the length of the tunnel. The end portion 90 is expanded radially outwardly to form a boundary layer thereafter.

In the example illustrated, the second portion of the length of the tunnel is shorter than the first portion of the length of the tunnel by two turns of the wire. Subsequent winding layers of the end portion are configured similar to the second layer with each subsequent layer being two turns of the wire shorter than the preceding layer to form a pyramid-like shaped end portion 90. Thereafter, the wire is wound in a succession of second individual turns to form a plurality of lengthwise extending layers, e.g. turns designated by 68–70, 71–73, 74–76, 77–79, 80–82, 83–85, and 86–88.

Figure 5:
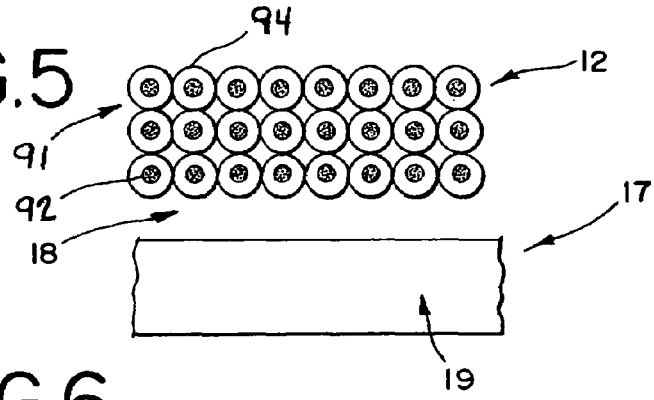
FIG. 5 is a partial cross sectional stylized view through an electroacoustic receiver having a coil wound with a heavily insulated wire.

Referring to FIG. 5, a coil 12 wound with an insulated wire 91 is illustrated. The insulated wire comprises a center portion 92 (usually copper), heavily insulated with a polymer based film 94. The film is designed to provide a uniform dielectric coating while taking up as little space as possible. Generally, AWG 43 to AWG 53 wire is used in hearing aid receivers.

For example, according to NEMA standards, a diameter of an AWG 50.0 bare wire would be approximately 0.00095–0.00103 ins. When a single build of insulation is added to the AWG 50 wire, the diameter is increased to 0.00105–0.00120 ins. When the insulation is increased to a heavy build, the diameter of the wire increases to 0.00115–0.00140 ins.

Adding insulation to the wire provides a larger effective spacing of the turns of the coil 12. According to NEMA standards, a single build film of insulation generally increases the diameter of the wire by a minimum of 0.00005 (for AWG 53.0) to 0.0005 ins. (for AWG 43.0); a heavy build film generally increases the diameter of the wire by a minimum of 0.00013 (for AWG 53.0) to 0.0008 ins. (for AWG 43.0); a triple build film generally increases the diameter of the wire by a minimum of 0.0002 (for AWG 53.0) to 0.0011 ins. (for AWG 43.0); and a quadruple build film generally increases the diameter of the wire by a minimum of 0.0003 (for AWG 53.0) to 0.0012 ins. for (AWG 43.0). Insulating films having these thicknesses, any range of these thicknesses, or any combination of these ranges are desirable. The effects are similar to using the high winding pitch. Heavy build insulated wire can reduce the capacitance in half, although it can add half again to the coil diameter.

Figure 6:
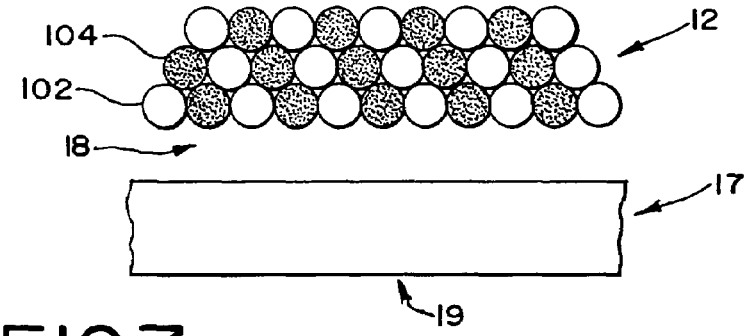
FIG. 6 is a partial cross sectional stylized view through an electroacoustic receiver having a coil wound with an insulated interwinding.

Referring to FIG. 6, a coil 12 wound with an insulated interwinding 100 is illustrated. In this example, an insulated thread 102 is wound beside a wire 104, The insulating thread 102 can be wound simultaneously with the wire 104, in a method similar to bifilar winding. The thread 102 places space between the turns of wire 104 which reduces capacitance. This method typically doubles the size of the coil 12.

Figure 7:
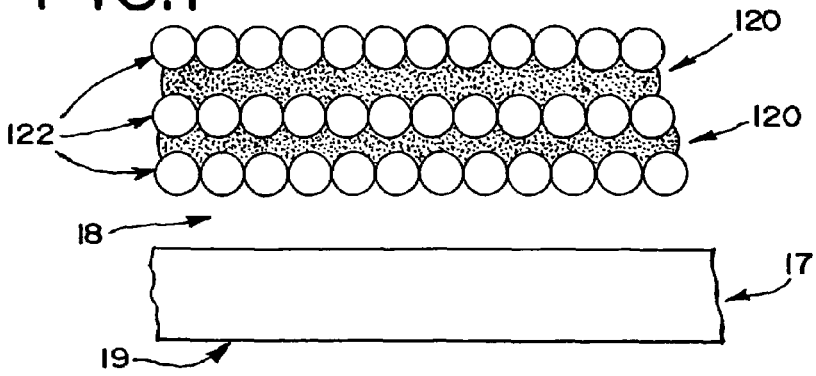
FIG. 7 is a partial cross sectional stylized view through an electroacoustic receiver having a coil wound with an insulating layer positioned between wire layers.

Referring to FIG. 7, a coil 12 with an insulated layer 120 is illustrated. Capacitance can be reduced by wrapping a partially completed coil with an insulator 120 before winding the rest of the turns. The insulator 120 can be used between every layer of wire 122, or after every few layers.

Further, it is also possible to use combinations of any of the above methods to further reduce parasitic capacitance and improve hearing aid battery life.

While specific embodiments have been illustrated and described, numerous modifications come to mind without significantly departing from the spirit of the invention, and the scope of protection is only limited by the scope of the accompanying claims.

What is claimed is:

1. An electroacoustic receiver for use in a hearing aid further including a power source, an audio input, and a signal processor wherein the receiver is driven with a switching signal having a carrier frequency, the electroacoustic receiver comprising: a pair of spaced permanent magnets; a coil having a tunnel therethrough, the coil comprising a conductive element having a thickness and formed into a winding, the winding including a plurality of spaced turns forming a plurality of winding layers, the plurality of spaced turns having a parasitic capacitance between individual turns and a predetermined winding pattern and a predetermined winding pitch for reducing the parasitic capacitance.

2. The electroacoustic receiver of claim 1 wherein the winding pitch of the plurality of spaced turns includes a spacing between successive turns of at least three times the thickness of the conductive element.

3. The electroacoustic receiver of claim 2 further comprising an insulating material between successive layers of the plurality of winding layers.

4. The electroacoustic receiver of claim 3 further comprising an insulating element having a thickness and formed into an insulating winding including a plurality of insulating turns located in the spacing between successive turns of the plurality of spaced turns of the conductive element.

5. The electroacoustic receiver of claim 4 further comprising an insulating film wrapped about the conductive element.

6. The electroacoustic receiver of claim 5 wherein the predetermined winding pattern comprises a plurality of electrically connected spaced winding modules each module comprising a plurality of individual turns forming a plurality of individual layers.

7. The electroacoustic receiver of claim 6 wherein each spaced winding module comprises a bank winding.

8. The electromagnetic receiver of claim 7 wherein the bank winding comprises a second predetermined winding pattern comprising an end portion including a first layer of turns adjacent the tunnel and wound about the tunnel in a first direction along a length of the tunnel and a second layer of turns disposed radially outwardly from the first layer of turns and wound about the first layer of turns in a second direction along the length of the tunnel which is opposite to the first direction, the winding pattern further comprising a second portion including a plurality of turns forming a plurality of layers and progressing in the first direction along the length of the tunnel.

9. The electroacoustic receiver of claim 1 further comprising an insulating material between successive layers of the plurality of winding layers.

10. The electroacoustic receiver of claim 9 further comprising an insulating element having a thickness and formed into an insulating winding including a plurality of insulating turns located in the spacing between successive turns of the plurality of spaced turns of the conductive element.

11. The electroacoustic receiver of claim 10 further comprising an insulating film wrapped about the conductive element.

12. The electroacoustic receiver of claim 11 wherein the predetermined winding pattern comprises a plurality of electrically connected spaced winding modules each module comprising a plurality of individual turns forming a plurality of individual layers.

13. The electroacoustic receiver of claim 12 wherein each spaced winding module comprises a bank winding.

14. The electromagnetic receiver of claim 13 wherein the bank winding comprises a second predetermined winding pattern comprising an end portion including a first layer of turns adjacent the tunnel and wound about the tunnel in a first direction along a length of the tunnel and a second layer of turns disposed radially outwardly from the first layer of turns and wound about the first layer of turns in a second direction along the length of the tunnel which is opposite to the first direction, the winding pattern further comprising a second portion including a plurality of turns forming a plurality of layers and progressing in the first direction along the length of the tunnel.

15. The electroacoustic receiver of claim 1 further comprising an insulating element having a thickness and formed into an insulating winding including a plurality of insulating turns located between successive turns of the plurality of spaced turns of the conductive element.

16. The electroacoustic receiver of claim 15 further comprising an insulating film wrapped about the conductive element.

17. The electroacoustic receiver of claim 16 wherein the predetermined winding pattern comprises a plurality of electrically connected spaced winding modules each module comprising a plurality of individual turns forming a plurality of individual layers.

18. The electro acoustic receiver of claim 17 wherein each spaced winding module comprises a bank winding.

19. The electromagnetic receiver of claim 18 wherein the bank winding comprises a second predetermined winding pattern comprising an end portion including a first layer of turns adjacent the tunnel and wound about the tunnel in a first direction along a length of the tunnel and a second layer of turns disposed radially outwardly from the first layer of turns and wound about the first layer of turns in a second direction along the length of the tunnel which is opposite to the first direction, the winding pattern further comprising a second portion including a plurality of turns forming a plurality of layers and progressing in the first direction along the length of the tunnel.

20. The electroacoustic receiver of claim 1 further comprising an insulating film wrapped about the conductive element.

21. The electroacoustic receiver of claim 20 wherein the predetermined winding pattern comprises a plurality of electrically connected spaced winding modules each module comprising a plurality of individual turns forming a plurality of individual layers.

22. The electroacoustic receiver of claim 21 wherein each spaced winding module comprises a bank winding.

23. The electromagnetic receiver of claim 22 wherein the bank winding comprises a second predetermined winding pattern comprising an end portion including a first layer of turns adjacent the tunnel and wound about the tunnel in a first direction along a length of the tunnel and a second layer of turns disposed radially outwardly from the first layer of turns and wound about the first layer of turns in a second direction along the length of the tunnel which is opposite to the first direction, the winding pattern further comprising a second portion including a plurality of turns forming a plurality of layers and progressing in the first direction along the length of the tunnel.

24. The electroacoustic receiver of claim 1 wherein the predetermined winding pattern comprises a plurality of electrically connected spaced winding modules each module comprising a plurality of individual turns forming a plurality of individual layers.

25. The electroacoustic receiver of claim 24 wherein each spaced winding module comprises a bank winding.

26. The electromagnetic receiver of claim 25 wherein the bank winding comprises a second predetermined winding pattern comprising an end portion including a first layer of turns adjacent the tunnel and wound about the tunnel in a first direction along a length of the tunnel and a second layer of turns disposed radially outwardly from the first layer of turns and wound about the first layer of turns in a second direction along the length of the tunnel which is opposite to the first direction, the winding pattern further comprising a second portion including a plurality of turns forming a plurality of layers and progressing in the first direction along the length of the tunnel.

27. The electroacoustic receiver of claim 1 wherein the predetermined winding pattern of the conductive element comprises an end portion including a first layer of turns adjacent the tunnel and wound about the tunnel in a first direction along a length of the tunnel and a second layer of turns disposed radially outwardly from the first layer of turns and wound about the first layer of turns in a second direction along the length of the tunnel which is opposite to the first direction, the winding pattern further comprising a second portion including a plurality of turns forming a plurality of layers and progressing in the first direction along the length of the tunnel.

28. A method of reducing the current flow from and increasing the life of a battery provided in a hearing aid having an audio input, and a signal processor, the method comprising the steps of: providing an electroacoustic receiver driven by a switching signal having a carrier frequency, the receiver comprising a pair of spaced magnets, a coil having a tunnel therethrough, and a reed armature having a central portion that extends through the coil; and reducing a parasitic capacitance exhibited by the receiver coil by providing a predetermined winding pattern of a conductive element including a plurality of successive turns forming a plurality of successive winding layers and a predetermined winding pitch.

29. The method of claim 28 wherein the predetermined winding pitch includes a spacing between successive turns of at least three times a thickness of the conductive element.

30. The method of claim 28 wherein the reducing a parasitic capacitance step includes providing an insulating material between adjacent layers of the plurality of successive winding layers.

31. The method of claim 28 wherein the reducing a parasitic capacitance step includes providing an insulating element having a thickness and formed into an insulating winding including a plurality of insulating turns located in the between adjacent turns of the plurality of successive turns of the conductive element.

32. The method of claim 28 wherein the reducing a parasitic capacitance step includes providing an insulating film wrapped about the conductive element.

33. The method of claim 28 wherein the predetermined winding pattern comprises a plurality of electrically connected spaced winding modules each module comprising a plurality of individual turns forming a plurality of individual layers.

34. The method of claim 28 wherein the predetermined winding pattern is a bank winding.

35. The method of claim 34 wherein the bank winding comprises a second predetermined winding pattern comprising an end portion including a first layer of turns adjacent the tunnel and wound about the tunnel in a first direction along a length of the tunnel and a second layer of turns disposed radially outwardly from the first layer of turns and wound about the first layer of turns in a second direction along the length of the tunnel which is opposite to the first direction, the winding pattern further comprising a second portion including a plurality of turns forming a plurality of layers and progressing in the first direction along the length of the tunnel.

36. An electroacoustic receiver comprising: a pair of spaced permanent magnets; a coil having a tunnel therethrough, the coil comprising a wire having a thickness and formed into a wire winding, the wire winding including a plurality of individual turns having a winding pitch wherein a space between individual turns is between three times and six times the thickness of the wire, for reducing parasitic capacitance; and a reed armature having a central portion which extends through the coil.

37. An electroacoustic receiver comprising: a pair of spaced permanent magnets; a coil having a tunnel therethrough, the coil comprising a plurality of electrically connected winding modules, wherein a gap between adjacent winding modules is less than 5% of the width of one of the plurality of winding modules; and a reed armature having a central portion which extends through the coil.

38. An electroacoustic receiver comprising:

a pair of spaced permanent magnets;

a coil having a tunnel therethrough, the coil comprising a winding of a wire, the winding having an end portion formed by a first plurality of individual turns originating at a point adjacent the tunnel and expanding radially outwardly to form an isosceles-triangle shaped boundary layer, thereafter the wire being wound in second succession of individual turns to form a plurality of horizontally disposed layers, wherein a number of radially disposed layers in the end portion is at least a number of radially disposed layers in at least one horizontally disposed layer in the plurality of horizontally disposed layers to effect a reduction in parasitic capacitance; and a reed armature having a central portion which extends through the coil.

* * * * *

UNITED STATES PATENT AND TRADEMARK OFFICE

CERTIFICATE OF CORRECTION

PATENT NO. : 7,050,602 B2
APPLICATION NO. : 09/928673
DATED : May 23, 2006
INVENTOR(S) : Thomas E. Miller It is certified that error appears in the above-identified patent and that said Letters Patent is hereby corrected as shown below:

Title page item (73), "LLC.," should be -- LLC, --.

At Column 6, line 9, "electro acoustic" should be -- electroacoustic --.

At Column 7, lines 32-33, "located in the between" should be -- located between --.

Signed and Sealed this

Ninth Day of January, 2007

JON W. DUDAS
*Director of the United States Patent and Trademark Office*